US008322450B2

(12) United States Patent
Meijer

(10) Patent No.: US 8,322,450 B2
(45) Date of Patent: Dec. 4, 2012

(54) WELLBORE PACKER

(75) Inventor: John R. Meijer, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 90 days.

(21) Appl. No.: 12/474,435

(22) Filed: May 29, 2009

(65) Prior Publication Data

US 2009/0294137 A1 Dec. 3, 2009

Related U.S. Application Data

(60) Provisional application No. 61/057,136, filed on May 29, 2008.

(51) Int. Cl.
*E21B 33/12* (2006.01)

(52) U.S. Cl. ..... 166/387

(58) Field of Classification Search ..... 166/118–152, 166/181–188, 387
See application file for complete search history.

(56) References Cited

U.S. PATENT DOCUMENTS

| | | | | |
|---|---|---|---|---|
| 4,044,826 | A * | 8/1977 | Crowe | 166/120 |
| 4,078,606 | A | 3/1978 | Montgomery | |
| 4,311,194 | A * | 1/1982 | White | 166/120 |
| 4,662,453 | A | 5/1987 | Brisco | |
| 4,753,444 | A * | 6/1988 | Jackson et al. | 277/342 |
| 6,186,227 | B1 | 2/2001 | Vaynshteyn et al. | |
| 6,315,050 | B2 | 11/2001 | Vaynshteyn et al. | |
| 6,564,876 | B2 | 5/2003 | Vaynshteyn et al. | |

OTHER PUBLICATIONS

Schlumberger, "HiPack Packer System" Retrieved from www.slb.comlwelltesting, 2009. pp. 1-2.

* cited by examiner

*Primary Examiner* — Kenneth L Thompson
*Assistant Examiner* — Kipp Wallace
(74) *Attorney, Agent, or Firm* — Rodney Warfford; Chad Sullivan; Matt Abrell

(57) ABSTRACT

A wellbore packer having a setting mechanism adapted to apply an axial force along a force path; a seal member connected with the setting mechanism along the force path, the seal member set in response to the application of the axial force; a slip connected with the setting mechanism downstream of the seal member along the force path, the slip set in response to the application of the axial force; and an assembly adapted to transfer the axial force around the intervening seal member to the slip.

9 Claims, 5 Drawing Sheets

WELLBORE PACKER

RELATED APPLICATIONS

This application claims the benefit of U.S. Provisional Patent Application No. 61/057,136 filed May 29, 2008.

TECHNICAL FIELD

The present invention relates in general to wellbore operations and equipment and in particular to a wellbore packer and method of setting the packer in a well.

BACKGROUND

Packers are generally utilized in wellbore operations to provide a seal (e.g., annular seal) or barrier to fluid flow across an annulus formed between an inner tubular member and the wall of the wellbore (e.g., borehole, well). Packers may be used in open hole operations, wherein the portion of the wellbore in which the packer is set has not been completed, e.g., it has not been cased; as well as completed portions of the wellbore which are cased (e.g., casing, liner, etc.). In some operations, the packer includes a sealing portion, typically an elastomer portion, which is expanded radially out from the mandrel to engage the wellbore wall to form the barrier.

The elastomer ring may be expanded radially in various manners including mechanical manipulation (e.g., rotation), inflation, and by compressing the elastomer portion. The force to compress the elastomer ring is commonly provided by hydraulic pressure and/or by weight. The wellbore operation being performed will often dictate the preferred type of packer, e.g., inflatable, hydraulically set, weight set, etc.; and may dictate whether the packer is retrievable or permanent.

One example of a wellbore operation in which one or more packers is utilized is in wellbore testing operations, for example drillstem testing ("DST"). For example, for the purpose of measuring a characteristic of the well (e.g., formation pressure, flow rates, etc.) of a subterranean formation, a tubular test string may be dispose in the wellbore that extends into the formation. In order to test a particular region, or zone, of the formation the test string may include a perforating gun that is used to form perforation tunnels, or fractures, into the formation surrounding the wellbore and perforations through the casing. To isolate the test zone, for example from the surface of the well, the test string may carry a packer to be set at the desired location in the well.

Examples of packer and packer systems that may be utilized, for example, for well testing are disclosed in U.S. Pat. Nos. 6,186,227, 6,315,050, and 6,564,876, all of which are incorporated herein by reference. There is a continued desired to provide reliable, robust, wellbore packers and packer systems.

SUMMARY

One embodiment of a wellbore packer includes a setting mechanism adapted to apply an axial force along a force path; a seal member connected with the setting mechanism along the force path, the seal member set in response to the application of the axial force; a slip connected with the setting mechanism downstream of the seal member along the force path, the slip set in response to the application of the axial force; and an assembly adapted to transfer the axial force around the intervening seal member to the slip.

An embodiment of a packer for use inside a casing of a wellbore includes a mandrel having a top end and a bottom end; a seal element adapted to seal off a wellbore annulus when compressed, the seal element circumscribing the mandrel; a slip adapted to engage the casing, the slip connected to the mandrel between the bottom end and the seal element; a setting mechanism adapted to apply an axial force to anchor the slip and to compress the seal element in response to a fluidic pressure of the wellbore annulus; and an assembly adapted to transfer the axial force to the slip bypassing the intervening seal element until the slip is set.

Another embodiment of a wellbore packer for use inside a casing in a wellbore includes a mandrel having a top end and a bottom end; a slip connected with the mandrel; a sliding shoe disposed on the mandrel between the slip and the top end of the mandrel; a seal element disposed on the sliding shoe; and a setting mechanism circumscribing a portion of the mandrel, wherein the setting mechanism is adapted to apply an axial force to actuate the slip into engagement with a casing and to actuate the seal elements to seal an annulus between the mandrel and the casing.

One embodiment of a method for operating a packer in a wellbore includes the steps of deploying the packer in a wellbore, the packer having a seal member and a slip disposed along an axial force path, the slip disposed downstream of the seal element in the axial force path; applying an axial force along the axial force path; transferring the axial force around the seal member to set the slip; and transferring, after the slip is set, the axial force to the seal element to set the seal element.

The foregoing has outlined some of the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
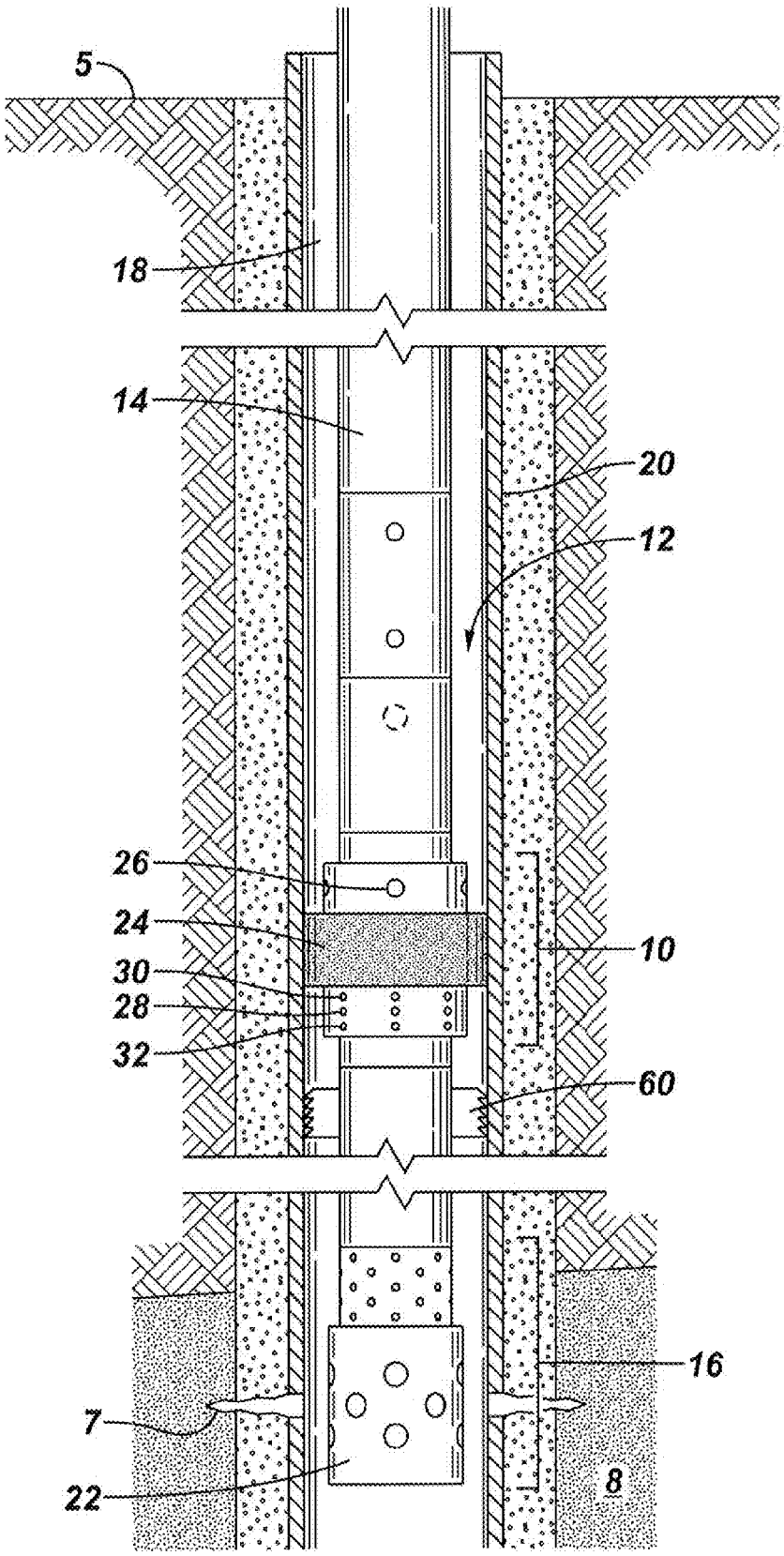
FIG. 1 is a schematic view of a packer in accordance with an embodiment of the invention disposed in a wellbore on a test string.

Refer now to the drawings wherein depicted elements are not necessarily shown to scale and wherein like or similar elements are designated by the same reference numeral through the several views.

FIG. 1 is a schematic view of a packer, generally denoted by the numeral 10, in accordance with an embodiment of the invention disposed in a wellbore 12. In this illustrated embodiment, packer 10 is being utilized in well testing operation (e.g., drillstem testing). In the illustrated embodiment, packer 10 is a hydraulically set, retrievable packer that may be run downhole with a tubing, or test string 14, and set (to form a test zone 16) by applying hydraulic pressure via annulus 18. In some embodiments, packer 10 may be placed in three different configurations: a run-in-hole configuration, a set configuration, and a pull-out-of-hole configuration. Packer 10 is placed in the run-in-hole configuration before being lowered into wellbore 12 on a conveyance, such as test string 14 in this embodiment. Once packer 10 is in the desired position in wellbore 12, pressure is transmitted via fluid present in annulus 18 to place packer 10 in the set configuration in which packer 10 secures (e.g., anchors) itself to well casing 20, in the illustrated embodiment, isolating (e.g., sealing off) test zone 16 across annulus 18, permitting string 14 to move through packer 10, and maintaining a seal 62 (FIG. 2) between the interior of packer 10 and the exterior of string 14. After testing is complete, an upward force may be applied to string 14 to place packer 10 in the pull-out-of-hole configuration to disengage packer 10 from casing 20.

In some embodiments of packer 10, string 14 may be allowed to linearly expand and contract without requiring slip joints. Because string 14 is run downhole with packer 10 in the illustrated embodiment, seals between string 14 and packer 10 remain protected as packer 10 is lowered into or retrieved from wellbore 12. In the illustrated embodiment, a perforating gun 22 is connected with packer 10 for creating a perforation tunnel 7 through casing 20 and into subterranean formation 8. It is noted that one or more other tools may be included with packer 10 in addition to or replacing perforating gun 22.

Packer 10 includes an annular, resilient elastomer seal element 24 in this embodiment to form an annular seal between the exterior of packer 10 and the interior of casing 20 (in the set configuration of packer 10). In this embodiment, packer 10 is configured to convert pressure exerted by fluid in annulus 18 of the well into a force to anchor packer 10 with casing 20 and to compress seal element 24. This pressure may be a combination of the hydrostatic pressure of the column of fluid in annulus 18 as well as pressure that is applied from the surface 5 of the well (e.g., pumped) via the annulus. As will be described further below, packer 10 is adapted to transfer this axial force, e.g., hydraulic force, across packer 10 to set slips 60 bypassing the intervening elastomeric seal element 24 until slips 60 are set (e.g., engaging casing 20). When compressed, seal element 24 expands radially outward and forms an annular seal with the interior of casing 20. Packer 10 is constructed to hold seal element 24 in this compressed state until packer 10 is placed in the pull-out-of-hole configuration, a configuration in which packer 10 releases the compressive forces on seal element 24 and allows seal element 24 to return to a relaxed position.

Because the outer diameter of seal element 24, in the uncompressed state, may be closely matched to the inner diameter of casing 20, there may be only a small annular clearance between seal element 24 and casing 20 as packer 10 is being retrieved from or lowered into wellbore 12. To circumvent the forces present as a result of this small annular clearance, packer 10 is may permit fluid to flow through packer 10 (e.g., bypass) when packer 10 is being lowered into or retrieved from wellbore 12. To accomplish this, packer 10 may have radial bypass ports 26 that are located above seal element 24. In the run-in-hole configuration, packer 10 is constructed to establish fluid communication between radial bypass ports 28 located below seal element 24 and radial ports 26, and in the pull-out-of-hole configuration, packer 10 is constructed to establish fluid communication between other radial ports 30 located below seal element 24 and radial ports 26. Radial ports 26 above seal element 24 are always open. However, when packer 10 is set, radial ports 30 and 28 are closed. Packer 10 may also have radial ports 32 that are used to inject a kill fluid to "kill" the producing formation. Ports 32 are located below seal element 24 in a lower housing 42 (described below), and each port 32 may be a part of a bypass valve.

Figure 2:
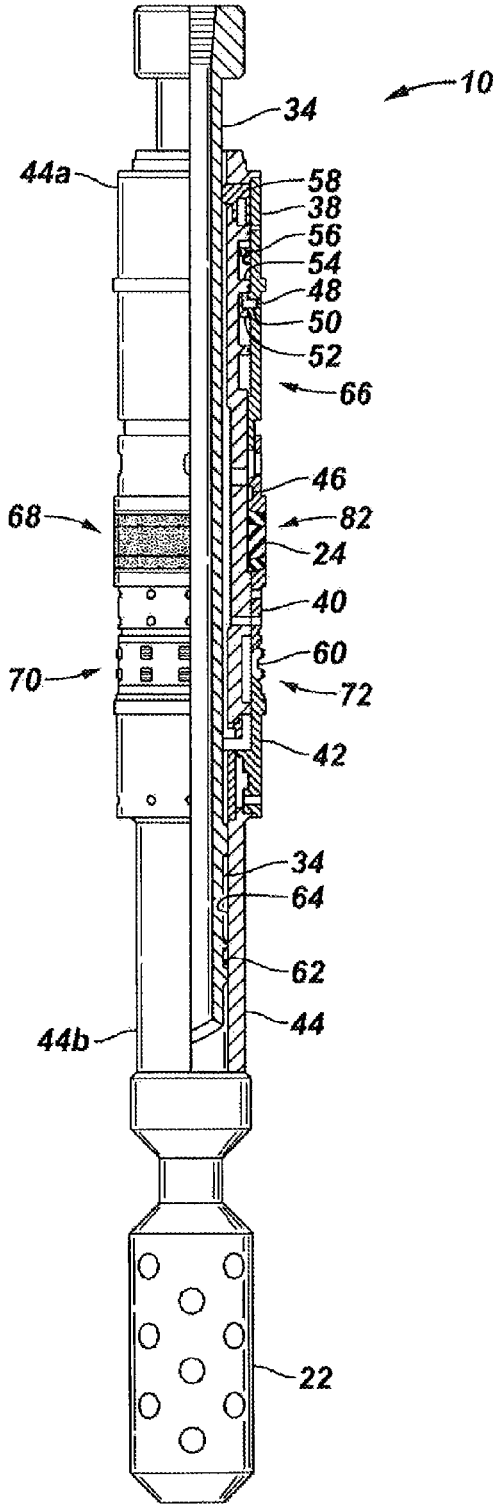
FIG. 2 is a schematic view of a packer in accordance with an embodiment of the invention.

Refer now to FIG. 2, wherein a schematic view of a packer 10 in accordance with an embodiment of the invention is provided. Packer 10, as illustrated in FIG. 2, generally includes a setting mechanism 66, a sealing element mechanism 68, a bypass sleeve mechanism 70, and an anchor mechanism 72. As will be understood from the following description, the various mechanisms operationally and functionally interconnected to form packer 10. It is further noted for full understanding, that specific features of the various embodiments of packer 10 may be included in one or more of the mechanism of packer 10 which are generally denoted for purposes of description as the setting mechanism 66, sealing element mechanism 68, bypass sleeve mechanism 70 and the anchor mechanism 72. It is further noted that the one or more designated mechanisms may overlap along the longitudinal length of packer 10.

FIG. 2 is now described with reference to FIG. 1. In this embodiment, packer 10 includes a stringer 34 (e.g., tubing) that is coaxial with and shares a central passageway 36 with string 14. Stinger 34 forms a section of string 14 and has threaded ends to connect packer 10 into string 14. In the illustrated embodiments, stinger 34 is stabbed into a packer mandrel 44 (e.g., body). Mandrel 44 is circumscribed by seal element 24 and a housing comprising an upper housing 38, a middle housing 40 and a lower housing 42 in the depicted embodiment. Mandrel 44 includes a top end **44*a* and a bottom end 44*b* relative to surface 5 and wellbore 12 illustrated in FIG. 1. When sufficient pressure (e.g., hydraulic, hydrostatic, fluid, etc.) is applied to annulus 18, housings 38, 40, and 42 (e.g., setting mechanism 66) are constructed to transfer an axial force to urge slips 60 (e.g., barrel slips) into engagement with the inside diameter of casing 20 and to compress seal element 24 to provide the annular barrier. Seal element 24 is located between upper housing 38 and middle housing 40, with lower housing 42 supporting middle housing 40 in the depicted embodiment. Stinger 34 may be releasably disposed with packer mandrel 44. For example, when packer 10 is run into the hole (e.g., wellbore 12) stinger 34 may be locked to packer mandrel 44 and a stinger seal 62 positioned in seal bore 64. When packer 10 is at the desired depth, annulus 18 pressure may be applied to activate the hydraulic setting mechanism, for example rupture disc 48, piston head 52, atmospheric chamber 56, housings 38, 40, 42 as described further below. The hydrostatic pressure sets slips 60 (e.g., bidirectional slips in some embodiments), closes the bypass ports, and energizes sealing element 24. Ratchet mechanism 46 may lock packer 10 in the set position and retain the applied setting forces. Once packer 10 is set, stinger 34 may be unlocked and released from packer mandrel 44, and seal 62 may be free to move in seal bore 64. In some embodiments, a pulling force (e.g., axial force toward surface 5 of FIG. 1) may move slips 60 back to a relaxed position releasing packer 10** from the casing.

Mandrel 44, along with radial ports 30, 28 and 26, effectively form a bypass valve. For example, mandrel 44 may have radial ports that align with ports 28 when packer 10 is placed in the run-in-hole configuration to allow fluid communication between ports 28 and 26. Mandrel 44 may block fluid communication between ports 30 and 28 and ports 26 when packer 10 is placed in the set configuration, and mandrel 44 may permit communication between ports 30 and 26 when packer 10 is placed in the pull out of the hole configuration.

In this embodiment, lower housing 42 is releasably attached to mandrel 44, and upper housing 38 is attached to mandrel 44 via ratchet mechanism 46 that is secured to middle housing 40. As upper housing 38 and lower housing 42 move closer together to compress seal element 24, teeth on upper housing 38 crawl down teeth that are formed in mandrel 44 in some embodiments. Ratchet mechanism, or ratchet lock, 46 maintains the compressive forces on seal element 24 until packer 10 is actuated to the pull-out-of-hole configuration.

When packer 10 is located in the desired position in wellbore 12, packer 10 is set (e.g., actuated, energized) by applying pressure to the fluid in annulus 18. When the pressure in annulus 18 exceeds a predetermined level, the fluid pierces a rupture disc 48 that is located in a radial port 50 formed by upper housing 38 in this embodiment. When disc 48 is pierced, port 50 establishes fluid communication between annulus 18 and an upper face of an annular piston head 52 of upper housing 38. Piston 52 is located below a mating annular piston head 54 of mandrel 44. An annular atmosphere chamber 56 is formed above piston head 52. Thus, when fluid communication is established between annulus 18 and piston head 52, the hydraulic pressure acts on piston head 52, and on upper housing 38) and when a shear member 58 (e.g., stinger release) securing upper housing 38 and mandrel 44 together shears, upper housing 38 begins moving downward (relative to surface 5 of FIG. 1) resulting in compressing seal element 24. To set packer 10 the actuating force is an axial force that acts on slips 60, urging slips 60 radially outward to secure with casing 20, anchoring packer 10 with casing 20. In the illustrated embodiment of FIG. 2, slips 60 are disposed between middle housing 40 and lower housing 42. In this embodiment, perforating gun 22 is hung from mandrel 44 and positioned below seal element 24 and not from stinger 34. It is noted that the perforating gun is illustrated for purposes of describing one embodiment.

Figure 3:
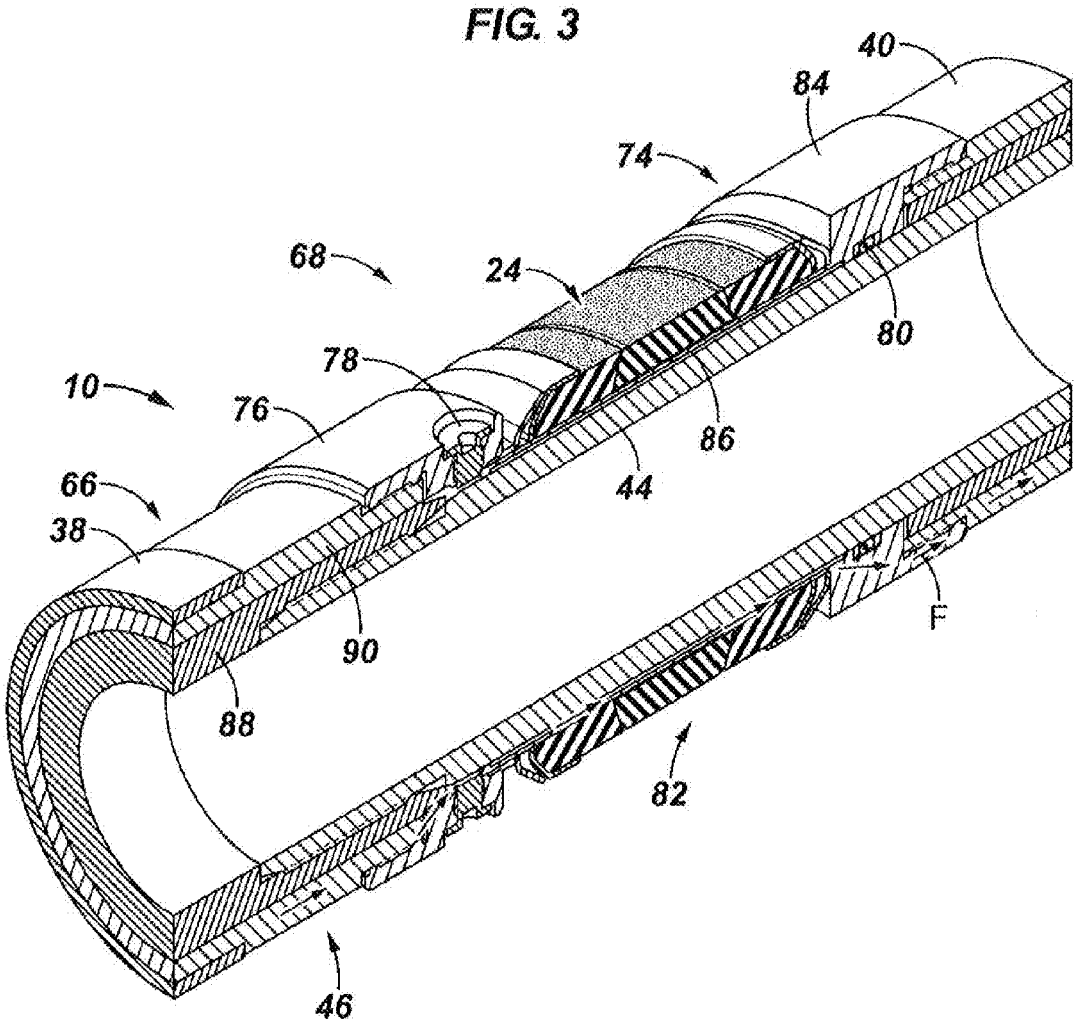
FIG. 3 is a cut-away perspective view of a seal element mechanism of a packer in accordance with and embodiment of the invention.

Refer now to FIG. 3, wherein a perspective, cut-away view of a sealing element mechanism 68 of packer 10 in accordance with the invention is provided. In this embodiment, sealing element mechanism 68 includes an assembly 82 (e.g., sliding shoe assembly) that includes seal element 24, a sliding shoe (e.g., sleeve) 74, a sliding shoe gage ring 76, a sliding shoe shear member (e.g., pin) 78, and a sliding shoe seal member 80. In the illustrated embodiment, seal element 24 is a double fold back element stack, which includes a plurality of elastomeric (e.g., rubber) packer elements). Seal element 24 is connected to and moveable with sliding shoe 74. Sliding shoe 74 is described as having a head portion 84 and an elongated shelf 86. In the illustrated embodiment, sliding shoe 74 substantially circumscribes packer mandrel 44. Seal element 24 is operationally connected with shelf 86. Head portion 84 of sliding shoe 74 is oriented toward slips 60 (FIGS. 2, 4) in this embodiment when shoe 74 is disposed on mandrel 44. Gage ring 76 can be connected with sliding shoe 74 via shear member 78. In the depicted embodiment, gage ring 76 is connected to shelf 86 of shoe 74 distal from head portion 84, wherein seal element 24 is disposed between gage ring 76 and head portion 84 of shoe 74. The assembled sliding shoe assembly 82 may be positioned on packer mandrel 44. Sliding shoe assembly 82 is operationally connected with ratchet mechanism 46 and middle housing 40 (e.g., pickup housing). In the depicted embodiment, head portion 84 of sliding shoe 74 forms a box end which is threadedly connected to middle housing 40. In the depicted embodiment, an upper ratchet mandrel 88 is threadedly connected to a pin end of packer mandrel 44. An outer ratchet portion 90 disposed with upper ratchet mandrel 88 is connected, via threading in this embodiment, to gage ring 76.

As will be further described below, sliding shoe assembly 82 provides a means for transferring the axial force, illustrated by the arrows, from setting mechanism 66 to slips 60 (FIG. 2) around, e.g., bypassing, seal element 24 to set (e.g., actuate) slips 60 and anchor the packer to the casing and then to facilitate the application of the axial force to seal elements 24 to compress and set the seal element. The axial force transfer across setting mechanism 66 (e.g., housing) bypassing seal element 24 facilitates setting slips 60 through seal element 24 without setting or prematurely setting seal element 24 until after slip 60 is set (e.g., delaying the setting of the seal element). This force transfer mechanism reduces loss of energy in the axial force that occurs when acting through seal elements 24 thereby facilitating achieving the setting force required at the slips and minimizing the actuating force needed at the setting mechanism and/or the wellbore annulus.

Figure 4:
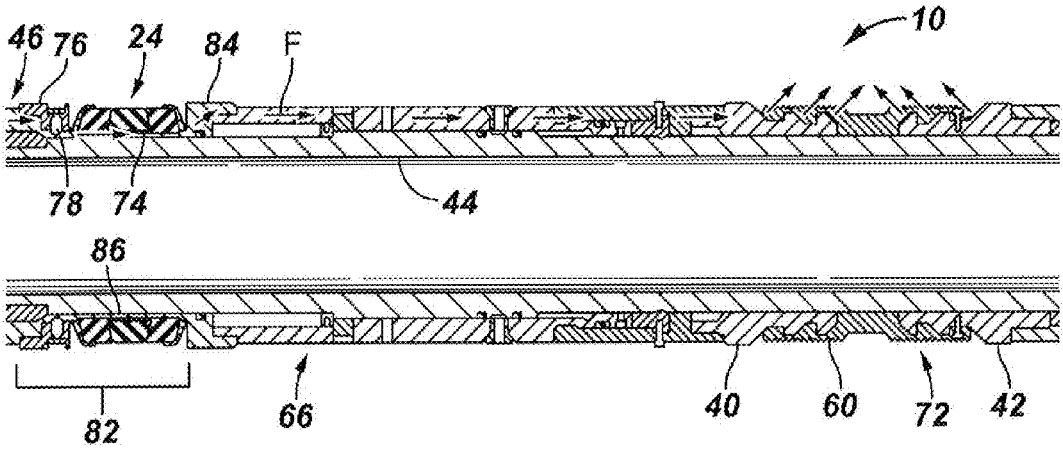
FIG. 4 is a cut-away view of a packer conceptually illustrating an axial setting force path in accordance with an embodiment of the invention.

FIG. 4 is a cut-away view of packer 10. Operation of packer 10 in accordance with an embodiment of the invention is now described with reference to FIGS. 1-4. A first hydraulic pressure is established in annulus 18 to actuate packer 10 so as to anchor packer 10 via slips 60 to casing 20 and to compress seal element 24 and thereby radially expand seal element 24 to form an annular barrier in wellbore 12. The actuating force and action of setting mechanism 66 is described above with reference to FIG. 2. Another embodiment of function of a setting of packer 10 is disclosed in U.S. Pat. Nos. 6,186,227, 6,315,050, and 6,564,876, all of which are incorporated herein. The axial actuating force is illustrated by the arrows. The actuating force provided via the setting mechanism is applied, in this embodiment, from upper housing 38 through ratchet mechanism 46 to slide shoe gage ring 76. The actuating (e.g., setting) force is transferred from gage ring 76 via shear member 78 (e.g., pin, screw, ring etc.) to sliding shoe 74 and then to middle housing 40. This force transfer includes transferring the setting force from the setting mechanism above seal element 24 to slips 60 by transferring the force through sliding shoe 74 (e.g., shelf 86 and head portion 84) without passing through seal elements 24 and avoiding setting, or actuating, seal elements 24. Thus, the axial setting force above seal element 24 is not significantly reduced at slips 60 due to actuation of seal elements 24. It is suggested that this force transfer method and system may reduce the loss in axial setting force due to actuating seal elements 24 by half relative to prior packers. Sliding shoe assembly 82 may further provide a seal element set delay function. The element set delay is utilized to mean that the sliding shoe assembly and methods of use provide minimal relative movement of seal element 24 relative to casing 20 during actuation (e.g., setting). In prior packers, the seal element often engages casing 20 as it drags down during bypass valve closing and during the setting (e.g., anchoring) of slips 60. It is believed that the functionality of sliding shoe assembly 82 may provide better and more consistent seals with the casing.

Continuing with the process and method of operating packer 10, as the axial force is transferred across sliding shoe assembly 82 to middle housing 40, seal elements 24 are carried down mandrel 44 with sliding shoe 74 toward slip 60. This movement, and the transfer of the actuating force, occurs without actuating seal elements 24. The axial force, referred to herein as a full axial force indicating that it is not reduced due to actuation of seal elements 24, is transferred to slips 60 via middle housing 40 to slips 60. When the axial force overcomes the parting limit (e.g., load) of slip shear member 92 (e.g., pin, screws, ring, etc.), middle housing 40 moves toward lower housing 42 urging slips 60 (e.g., barrel slips) radially away from mandrel 44 and into sealing engagement with casing 20. In this embodiment, slip shear member 92 is connected between lower housing 42 and slip 60.

During the setting process sliding shoe 74 carries seal elements 24 in an undisturbed (e.g., a substantially un-actuated, un-energized, un-compressed, etc.) manner along mandrel 44. Upon setting (e.g., anchoring) slips 60, the actuating force acts on sliding shoe assembly 82 to energize (e.g., actuate) seal elements 24 radial outward from mandrel 44 into engagement with casing 20. For example, upon setting slips 60 anchoring packer 10 relative to casing 20, the full axial force "F" acts on sliding shoe assembly 82 and in particular sliding shoe gage ring 76 urging sliding shoe gage ring 76 toward head portion 84 of sliding shoe 74; sliding gage ring 76 is held stationary relative to head portion 84 until the predetermined load provided by the one or more sliding shoe shear members 78 is overcome by axial force "F" releasing sliding shoe gage ring 76 for movement toward head portion 84 thereby compressing seal elements 24 and expanding them radially into contact with casing 20.

Figure 5:
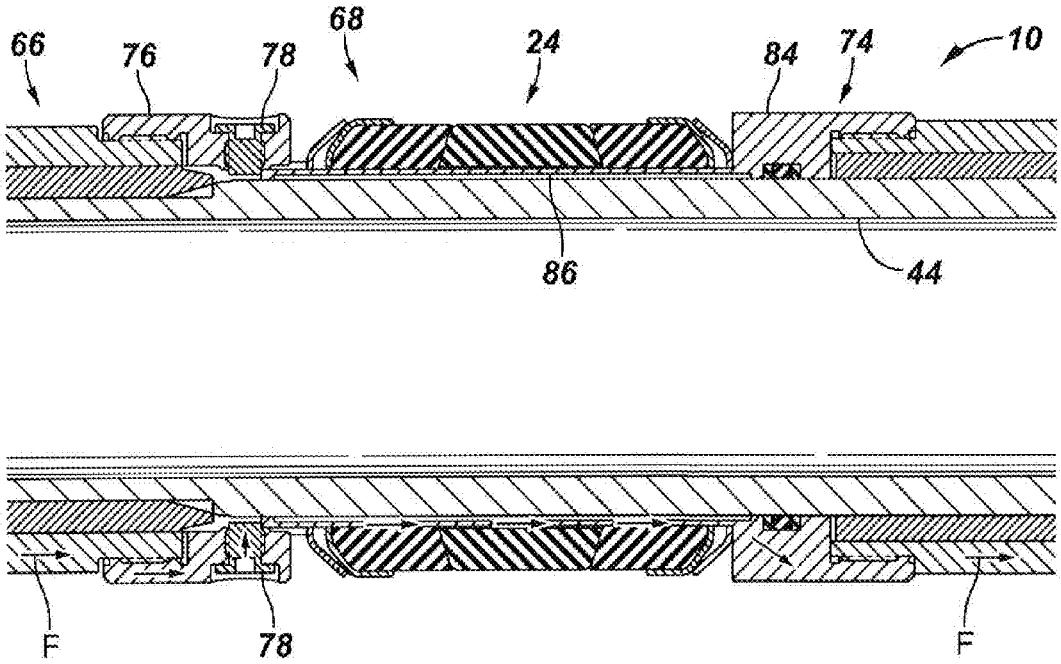
FIG. 5 is a cut-away view of a seal element mechanism of a packer in accordance with an embodiment of the invention conceptually illustrating transfer of the axial setting force to bypass the seal element.
Figure 6:
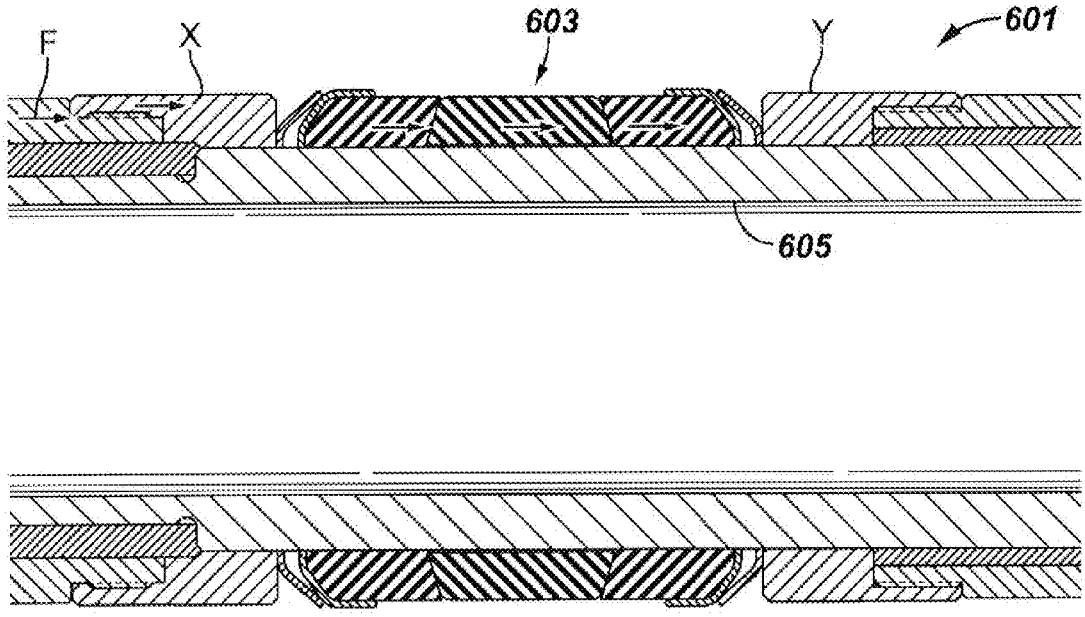
FIG. 6 (Prior Art)
FIG. 6 is a cut-away view of a seal portion of a prior art set through type packer conceptually illustrating the path of the axial setting force.

FIG. 5 is a cut-away view of an embodiment of a seal element mechanism 68 of packer 10. FIG. 5 conceptually illustrates the force transfer functionality of packer 20 in accordance to an embodiment of the invention. FIG. 6 is a cut-away view of a seal element mechanism of a prior art set through packer conceptually illustrating a path of the axial setting force. An example of the force transfer provided by packer 10 is now described with reference to FIGS. 5 and 6. As described above with reference to FIGS. 1-4, packer 10 provides for force transfer which is used to mean that sliding shoe 74 minimizes the force "F" needed to set packer 10 as the force "F" is not substantially reduced by compressing seal element 24 during the step of anchoring (e.g., actuating slips 60 (FIGS. 2 and 4)) packer 10 with the casing. Force "F" is applied to sliding shoe gage ring 76 and to sliding shoe 74 via the connection, in this embodiment, of sliding shoe gage ring 76 to shelf 86 by sliding shoe shear mechanism 78. As described above, the force causes sliding shoe 74, carrying seal elements 24, to move relative to mandrel 44 toward slips 60 (FIG. 4) during the step of setting slips 60. Thus, the axial force "F" at sliding shoe shear mechanism 78 is substantially same as the axial force "F" at head portion 84 of sliding shoe 74 on the opposite side of seal elements 24 from sliding shoe shear mechanism 78 and gage ring 76. This transfer of axial force "F" to bypass seal elements 24 during the step of anchoring packer 10 and may provide for operating packer 10 at a lower hydrostatic pressure than traditional set-through packers.

Packer 10, and seal element mechanism 68 and sliding shoe 74 assembly in particular, may also provide what may be referred to as an "element set delay" function relative to traditional set through type packers, such as illustrated in FIG. 6. "Element set delay" may be utilized to mean that during a traditional set through packer process, the sealing element engages the casing and drags down as the bypass valve closes and the slips set. In the depicted embodiment of FIGS. 4 and 5, seal elements 24 are carried downhole (e.g., toward the slips) along mandrel 44 by sliding shoe 74 during the step of actuating slips 60 into engagement with the casing without compressing seal elements 24 and prematurely actuating them radially into contact with the casing prior to engagement of slips 60 with casing 20. This function may reduce the movement of seal elements 24 relative to the casing when in contact with the casing thereby reducing seal failures. The process of setting packer 10 may be referred to as a continuous two-step process, relative to a traditional set through type packers such as illustrated in FIG. 6 for example. In other words, axial force "F" bypasses seal elements 24 to set slips 60 and then when slips 60 are set (e.g., engaged with the casing) axial force "F" is applied to set seal elements 24.

Referring to FIG. 6, a seal element portion of a prior art set through type packer, denoted by the numeral 601, is conceptually illustrated. Packer 601 includes a seal element 603 circumscribing a mandrel 605. Although not illustrated in FIG. 6, packer 601 includes slips adapted to anchor packer 601 to the casing to anchor the packer with the casing. As described with reference to packer 10 and FIGS. 1-5, the slips of packer 601 are positioned downhole and downstream of seal elements 603 relative to the surface of the wellbore and relative to the application of axial force "F". In the traditional set through packer, axial force "F" is applied to set packer 601, including setting the slips and setting seal elements 603. During the setting step, axial force "F" acts on an upper housing 607 through seal elements 603 to a middle housing 609 to actuate the slips of packer 601, thus setting through seal elements 603. During this setting step, axial force "F" acts on seal elements 603 thus the axial force "F" available to set the slips is reduced. In other words, axial force "F" at point Y is less than axial force "F" at point X due to axial force "F" compressing seal elements 603 during the step of setting the slips. In the embodiment of packer 10 illustrated in FIG. 5 for example the axial force "F" is substantially the same at the relative positions of X and Y of the prior art set through packer of FIG. 6. It is noted that seal element 603 is not typically fully actuated into sealing engagement with the casing until the slips engage the casing. However, seal elements 603 radially expand and contact the casing while the slips are being set (e.g., actuated into contact with the casing). The radial expansion of the seal elements into contact with the casing during the step of anchoring the packer, which occurs in regard to set through packers such as illustrated in FIG. 6, may be referred to as premature setting of the seal element in embodiments of packer 10 as described in FIGS. 1-5. Due to the premature setting of seal elements 603, seal elements 603 may be dragged relative to and against the casing during while setting the slips which can result in a faulty seal with the casing. Some embodiments of packer 10 address this drawback of the prior set through packers with the element set delay functionality of packer 10 and sliding shoe 74.

Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A packer for use inside a casing of a wellbore, the packer comprising:

a mandrel having a top end and a bottom end;

a seal element to seal off a wellbore annulus when fully compressed, the seal element circumscribing the mandrel;

a slip to engage the casing when set, the slip connected to the mandrel between the bottom end and the seal element;

a setting mechanism to apply a full axial force to set the slip and to fully compress the seal element in response to a first fluidic pressure of the wellbore annulus; and an assembly comprising a shelf carrying the seal member, a gage ring connected to the shelf by a shear member, and a head portion, wherein the assembly transfers application of the full axial force through a force path to the slip bypassing application of the full axial force to the intervening seal element until the slip is set engaging the casing:

wherein the force path extends from the setting mechanism to the gage ring, from the gage ring through the shear member to the shelf, and from the shelf to the slip; and wherein the seal element is fully compressed in response to the application of the full axial force after the slip is set in response to the application of the full axial force.

2. The packer of claim 1, wherein the assembly is slidingly disposed on the mandrel to move with the setting mechanism in response to the first fluidic pressure on the setting mechanism.

3. The packer of claim 1, further comprising a tool connected to the mandrel proximate to the bottom end of the mandrel.

4. The packer of claim 3, wherein the tool is a perforating gun.

5. A method for operating a packer in a wellbore, the method comprising:

deploying the packer in a wellbore, the packer having a seal member and a slip disposed along an axial force path, the slip disposed downstream of the seal element on the axial force path, wherein the axial force path extends from a setting mechanism to a gage ring, from the gage ring through a shear member to a shelf carrying the seal member, and from the shelf to the slip;

applying a full axial force along the axial force path in response to a first fluidic pressure in the wellbore annulus to the slip bypassing application of the full axial force on the intervening seal element until the slip is set;

setting the slip in response to the application of the full axial force;

applying, after the slip is set, the first full axial force to the seal element; and fully compressing the seal element in response to the applying the full axial force to the seal element after the slip is set in response to the applying the full axial force.

6. The method of claim 5, wherein the bypassing the application of the full axial force around on the seal element comprises moving the shelf carrying the seal element toward the slip.

7. The method of claim 5, wherein the packer comprises a mandrel having a top end oriented toward the surface of the wellbore and a bottom end, wherein the seal element and the shelf are disposed on the mandrel between the top end and the slip, and the setting mechanism is disposed on the mandrel between the top end and the shelf.

8. The method of claim 5, wherein the applying the full axial force to the seal element after the slip is set comprises releasing the gage member to move relative to the shelf.

9. The method of claim 8, wherein the fully compressing the seal element comprises compressing the seal element between the released gage member and a head connected to the shelf.

* * * * *